US006461402B1

(12) United States Patent
Morita et al.

(10) Patent No.: US 6,461,402 B1
(45) **Date of Patent: *Oct. 8, 2002**

(54) MOLDING POWDER FOR CONTINUOUS CASTING OF STEEL AND METHOD FOR CONTINUOUS CASTING OF STEEL

(75) Inventors: Akihiro Morita; Tomoaki Omoto; Yukimasa Iwamoto, all of Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/601,323

(22) PCT Filed: Dec. 7, 1999

(86) PCT No.: PCT/JP99/06853

§ 371 (c)(1),
(2), (4) Date: Aug. 7, 2000

(87) PCT Pub. No.: WO00/33992

PCT Pub. Date: Jun. 15, 2000

(30) Foreign Application Priority Data

Dec. 8, 1998 (JP) ..... 10-348841

(51) Int. Cl.[7] ..... C21C 7/076
(52) U.S. Cl. ..... 75/305; 148/540
(58) Field of Search ..... 75/305; 148/540

(56) References Cited

FOREIGN PATENT DOCUMENTS

| | | | |
|---|---|---|---|
| JP | 02025254 A | * | 1/1990 |
| JP | 08033962 A | * | 2/1996 |
| JP | 09323142 A | * | 12/1997 |

OTHER PUBLICATIONS

English Translation of JP 02–025254, published Jan. 26, 1990. Yuyama et al.*

* cited by examiner

*Primary Examiner*—Roy King
*Assistant Examiner*—Tima McGuthry-Banks
(74) *Attorney, Agent, or Firm*—Oblon, Spivak, McClelland, Maier & Neustadt, P.C.

(57) ABSTRACT

An object of the present invention is to provide a mold powder for continuous casting of steel whose fluorine content is small, and which enables stable casting, for reducing the corrosion of continuous casting equipment and decreasing the concentration of fluorine in the waste water, well as a method for continuous casting of steel using mold powder. The mold powder for continuous casting of steel of the present invention is characterized by having a chemical composition including 25 to 70 wt % of $SiO_2$, 10 to 50 wt % of CaO, not more than 20 wt % of MgO, and 0 to 2 wt % of F as an unavoidable impurity, where the viscosity of the molten mold powder is not less than 4 poise at 1,300° C.

12 Claims, No Drawings

MOLDING POWDER FOR CONTINUOUS CASTING OF STEEL AND METHOD FOR CONTINUOUS CASTING OF STEEL

TECHNICAL FIELD OF THE INVENTION

The present invention relates to a mold powder for continuous casting of steel and a method for continuous casting of steel using the mold powder which can greatly suppresses the corrosion of continuous casting equipment, reduces fluorine concentration in the waste water, and which can realize stable casting even with reduced consumption.

RELATED ART

Mold powder is added on the surface of molten steel inside a mold, is melted by heat derived from the molten steel to form a molten slag layer, and progressively flows into the gap between the mold and the solidifying shell, to be consumed. Some of the major roles that the mold powder plays during this time are: (1) lubrication. between the mold and the solidifying shell; (2) dissolution and absorption of the inclusions which come to the surface of the molten steel; (3) prevention of reoxidation, and heat insulation of the molten steel; and (4) control of the speed of heat dissipation from the solidifying shell.

Regarding points (1) and (2), it is important to control the softening point, viscosity, etc. of the mold powder, and to determine the chemical composition. Regarding point (3), important factors are the melting rate and powder characteristics such as the bulk specific gravity and spreadability, which are controlled mainly by carbonaceous materials. Regarding point (4), the crystallization temperature etc., must be controled and the determination of the chemical composition is crucial.

A typical mold powder contains as base materials, Portland cement, synthetic calcium silicate, wollastonite, blast furnace slag, yellow phosphorus slag, dicalcium silicate ($2CaO.SiO_2$), etc., and also contains if necessary, siliceous materials for controlling the alkalinity and powder characteristics such as bulk density. Further, it generally contains flux materials such as fluorides including fluorite, cryolite, magnesium fluoride, etc., as moderators for controlling the melting characteristics such as softening point and viscosity, and carbonaceous materials such as carbonate including sodium carbonate, lithium carbonate, strontium carbonate, barium carbonate, etc., as moderators for controlling the speed of slag-form melting. As for the chemical composition, a mold powder contains $SiO_2$ and CaO as the main components, and $Al_2O_3$, MgO, BaO, SrO, $Li_2O$, $Na_2O$, F, MnO, $B_2O_3$, etc.

Among the roles of mold powders, the roles of of cuspidine crystals ($3CaO.2SiO_2.CaF_2$) in the slag film are significant role with regards to (4), control of the heat dissipation from the solidifying shell. Thus, fluorine, which is a constituent element of cuspidine, is an essential component for controlling the heat dissipation. Especially in the case of casting steels which tends to cause cast slab fractures, such as hypoperitectic steel, the role played by fluorine in the mold powder is important. To achieve slow cooling and uniform heat dissipation in the mold, the mold powder must have a high crystallization temperature. Accordingly, typical mold powders have compositions including high fluorine content. Fluorine also plays an important role regarding viscosity control and crystallization temperature control.

PROBLEMS TO BE SOLVED BY THE INVENTION

Since almost all of the currently-used mold powders purposely have fluorides, such as $CaF_2$, NaF, and $NaAlF_6$ added thereto, as flux, fluorine is contained therein, and so, they have the following problems. Mold powder melts when it comes into contact with molten steel, and then flows into the gaps between the cast slab and the mold to be consumed as a lubricant; however, since it contains fluorine, there is a problem that when it comes into contact with the secondary cooling water at the bottom of the mold, hydrofuluoric acid (HF) is generated by a reaction between the fluorine and the water, which lowers the pH of the cooling water. Accordingly, corrosion attacks equipment around the continuous casting equipment, which contacts the cooling water, especially the structures made of metal such as molds, rolls, pipes, nozzles, etc. Further, waste cooling water must be be neutralized. Still further, fluorine involves environmental problems, and concentration in the waste water is regulated. Still further, there is also a problem that a mold powder containing much fluorine increases the dissolution loss speed at the powder line of the submerged nozzle.

To solve the above-described problems caused by fluorine, there is disclosed, for example, in Japanese Patent Laid-open No. 50-86423, an additive for continuous casting of steel which is characterized by consisting of 10 to 50% of CaO, 20 to 50% of $SiO_2$, 1 to 20% of $Al_2O_3$, 0.1 to 10% of $Fe_2O_3$, 1 to 20% of $Na_2O$, 1 to 15% of C, 0.1 to 10% of $K_2O$, 0.1 to 5% of MgO, 0.1 to 20% of $B_2O_3$ if necessary, and other impurities, and having the form of powder.

In Japanese Patent Laid-open No. 51-132113, there is disclosed an additive for continuous casting of steel which is characterized by consisting of 10 to 50% of CaO, 20 to 50% of $SiO_2$, 1 to 20% of $Al_2O_3$, 0.1 to 10% of $Fe_2O_3$, 1 to 20% of $Na_2O$, 1 to 15% of C, 0.1 to 10% of $K_2O$, 0.1 to 5% of MgO, 0.1 to 10% of F if necessary, 0.1 to 20% of $B_2O_3$ if necessary, 0.5 to 10% of inorganic and organic binders, and other impurities in small quantities, and having the form of grain of which the diameter is, 0.1 to 5 mm.

In Japanese Patent Publication No. 56-29733, there is disclosed a refining agent for continuous casting of cast slabs, which do not contain any fluorides, and of which the compositions includes, 20 to 45% of CaO, 20 to 45% of $SiO_2$, 0.5 to 5% of $B_2O_3$, 3 to 15% of $Na_2O+K_2O+Li_2O$, where $CaO/SiO_2$ is controlled to be in the range of 0.8 to 1.2.

In Japanese Patent Laid-open No. 51-67227, there is disclosed a flux for casting of steel which consists of base material(s), flux(s), and slag formation moderator(s), and of which the chemical composition in the molten state includes the following: 30 to 60 wt % of $SiO_2$, 2 to 40 wt % of CaO, 1 to 28 wt % of $Al_2O_3$, 1 to 15 wt % of alkali metal oxide, 7 to 18 wt % of $B_2O_3$, 5 to 15 wt % of MnO, 1 to 5 wt % of FeO, and 0 to 17 wt % of C.

In Japanese Patent Laid-open No. 51-93728, there is disclosed a flux for continuous casting of steel which consists of, 50 to 80 parts by weight of $SiO_2$-CaO-$Al_2O_3$ ternary system base material, 1 to 15 parts by weight of alkali metal compound, 1 to 15 parts by weight of, at least one of manganese carbonate, manganese monoxide, ferromangenese, ferric oxide, and ilmenite, and less than 5 parts by weight of carbonaceous material as a slag formation moderator, and which do not contain fluoride.

In Japanese Patent Laid-open No. 58-125349, there is disclosed a mold additive for continuous casting, which is characterized by consisting of 30 to 40% of CaO, 30 to 45% of $SiO_2$, 3 to 20% of, at least one of $Na_2O$, $K_2O$, $Li_2O$, 3 to 6% of carbon in total, and 2 to 5% of $Al_2O_3$ if necessary, wherein compound ratio of CaO and $Sio_2$ follows the condition of $CaO/SiO_2$=0.68 to 1.2.

In Japanese Patent Laid-open No. 3-151146, there is exemplified a composition of a mold powder for the use in continuous casting of Al-killed ultra low carbon steel for deep drawing, which is, 0.5 to 5.0% of carbon in total, 20.0 to 40.0% of $SiO_2$, 20.0 to 40.0% of CaO, zero or not more than 8.0% of $Al_2O_3$, zero or not more than 10.0% of $Na_2O$, zero or not more than 6.0% of MgO, zero or not more than 10.0% of F, 5.0 to 30.0% of $B_2O_3$, zero or not more than 12.0% of $TiO_2$. This exemplification suggests the mold power in which the content of F is zero. According to this publication, however, all of the mold powders used in the examples contain 9.0% of F. Also, it is described that the viscosity of the mold powder at 1,300° C. is 1.0 to 1.3 poise.

In Japanese Patent Laid-open No. 5-208250, there is disclosed a mold additive for continuous casting of steel which is characterized by having chemical composition of, 30 to 45 wt % of CaO, 20 to 35 wt % of $SiO_2$, where the weight ratio $CaO/SiO_2$ is in the range of 1.25 to 2.0, not more than 8 wt % of $Al_2O_3$, 2 to 15 wt % of $B_2O_3$, 3 to 25 wt % of, at least one of $Na_2O$, $K_2O$ and $Li_2O$, 1 to 10 wt % of MgO, and 0.5 to 8 wt % of carbonaceous material. In the publication, it is also disclosed that that total amount of fluorine as unavoidable impurities, is not more than 1 wt %. According to the examples disclosed in this publication, viscosity of the mold additive at 1,300° C. is 0.7 to 1.1 poise, which is extremely low.

Currently, however, mold powders substantially free of fluorine as described above are not used in practice. This is attributable to a problem encountered with the use of mold powders substantially free of fluorine; that is, cuspidine which has a significant effect on heat dissipation from the mold does not crystallize in the slag film, and thus heat dissipation from the solidifying shell is rendered unstable. Accordingly, a warnings have issued predicting cast slab fractures or breakout, and stable casting operations are impeded. Thus, mold powders substantially free from fluorine requires a great amount of flux components such as $Na_2O$, $K_2O$, MnO, and $B_2O_3$, as alternative components to fluorine for the purpose of controlling the viscosity. In this case, however, gehlenite ($2CaO.Al_2O_3.SiO_2$), dicalcium silicate ($2CaO.SiO_2$), and tricalcium silicate ($3CaO.SiO_2$) crystallize at high temperatures. Such crystallization increases the difference in solidification temperatures between the high-melting crystal layer and the low-melting glass layer. Accordingly, the slag film is rendered nonuniform, and the heat dissipation from the solidifying shell is rendered unstable. In addition, the lubrication between the mold and the solidifying shell deteriorates when these crystals come out.

Thus, an object of the present invention is to provide a mold powder for continuous casting of steel in which the content of fluorine is small, and which enables stable casting, as well as a method for continuous casting of steel using the mold powder, in order to suppress the corrosion of continuous casting equipment and reduce the concentration of fluorine in the waste water.

MEANS FOR SOLVING THE PROBLEM

The inventors have discovered, as the result of various investigations, that a mold powder of which the chemical composition includes, 25 to 70 wt % of $SiO_2$, 10 to 50 wt % of CaO, not more than 20 wt % of MgO, and 0 to 2 wt % of F as unavoidable impurity, and of which the viscosity is not less than 4 poise in a molten state at 1,300° C., is effective for the above-described object.

Accordingly, the mold powder for continuous casting of steel according to the present invention is characterized by having the chemical composition including, 25 to 70 wt % of $SiO_2$, 10 to 50 wt % of CaO, not more than 20 wt % of MgO, and 0 to 2 wt % of F as an unavoidable impurity, and having a viscosity of not less than 4 poise in a molten state at 1,300° C.

Further, the mold powder for continuous casting of steel according to the present invention is characterized in that the mold powder in a molten state at 1,300° C. has a viscosity ranging from 4 to 200 poise.

Also, the mold powder for continuous casting of steel according to the present invention is characterized in that the total content of at least one component which is selected from the group consisting of $Na_2O$, $Li_2O$, and $K_2O$ is not more than 20 wt %.

Further, the mold powder for continuous casting of steel according to the present invention is characterized in that the ratio by weight of $CaO/SiO_2$ is in the range of 0.2 to 1.5.

Also, additionally, the mold powder for continuous casting of steel according to the present invention is characterized in that the content of carbon is in the range of 0.5 to 30 wt %.

Still further, the mold powder for continuous casting of steel according to the present invention is characterized in that the softening point is in the range of 1,070 to 1,250° C.

Also, the mold powder for continuous casting of steel according to the present invention is characterized in that the mold powder in the molten state at 1,300° C. has a rupture strength of not less than 3.0 $g/cm^2$.

Still further, the mold powder for continuous casting of steel according to the present invention is characterized in that the content of $Al_2O_3$ is not more than 20 wt %.

Also, the mold powder for continuous casting of steel according to the present invention is characterized in that the total content of at least one component which is selected from the group consisting of MnO, $B_2O_3$ BaO SrO, $TiO_2$, and $Fe_2O_3$ is in the range of 0.3 to 20 wt %.

Still further, the mold powder for continuous casting of steel according to the present invention is characterized by having either no crystallization temperature or a crystallization temperature of less than 1,250° C.

Also, the mold powder for continuous casting of steel according to the present invention is characterized in that the mold powder has no crystallization temperature, and the solidification temperature is less than 1,300° C.

Still further, the method of continuous casting of steel according to the present invention is characterized by using the above-described mold powder for continuous casting of steel, wherein the powder consumption is in the range of 0.02 to 0.30 $kg/M^2$.

MODE FOR CARRYING OUT THE INVENTION

When the content of fluorine in a mold powder is small, there is a problem that cuspidine which plays a significant role in heat dissipation control does not crystallize. This makes it difficult to control the heat dissipation from the solidifying shell. To solve this problem, the viscosity of the mold powder in a molten state is set high so that the mold powder flows uniformly and at a small rate into the gaps between the mold and the solidifying shell. Further, the tendency of the mold powder to crystallize is weakened so that a uniform slag film is formed, to realize uniform heat dissipation from the solidifying shell. Uniform heat dissipation brings about an uniform thickness of the solidifying shell to avoid cast slab fractures, and it is possible to prevent cast slab fractures even when the steel is of a type in which cast slab fractures tend to occur.

Increased viscosity of the mold powder reduces its consumption. Generally, over reduction in the consumption of the mold powder causes sticking between the mold and the solidifying shell, posing the increased danger of breakout occurring. Thus, to make the sticking between the mold and the solidifying shell more difficult to occur when consumption of the mold powder decreases, the following method is effective. That method entails weakening the crystallization tendency, while increasing the viscosity of the mold powder in the molten state at 1,300° C. Mold powders which contain crystals therein tend to easily tear at crystals under tensile stress, while mold powder in an amorphous phase is more resistive to tensile stress because of its ductility. In addition, the rupture of the liquid layer in the molten mold powder may also be suppressed by increasing the rupture strength of the molten mold powder.

The mold powder according to the present invention contains as an essential component, 25 to 70 wt % of $SiO_2$. A $SiO_2$ content of less than 25% makes the weight ratio $CaO/SiO_2$ too high, and therefore, is not preferred. Also, a $SiO_2$ content exceeding 70 wt % makes the weight ratio $CaO/SiO_2$ too low, and therefore, is not preferred either.

The mold powder according to the present invention also contains as an essential component, 10 to 50 wt % of CaO. A CaO content of less than 10% makes the weight ratio $CaO/SiO_2$ too low, and therefore, is not preferred. Also, a CaO content exceeding 50 wt % makes the weight ratio $CaO/SiO_2$ too high, and therefore, is not preferred either.

The weight ratio of $CaO/SiO_2$ is preferably in the range of 0.2 to 1.5, and more preferably, 0.2 to 0.8. A weight ratio $CaO/SiO_2$ of less than 0.2 or higher than 1.5 makes the melting point of the mold powder extremely high, and therefore, is not preferred.

In raw materials, MgO is contained as an impurity; thus, about 0.3 wt % of MgO may naturally exist in the mold powder as an unavoidable impurity. MgO, however, may intentionally be added to the above-described components, and be contained in the mold powder of the present invention to the extent of not more than 20 wt %. MgO is added mainly for the purpose of controlling the softening point, melting point and viscosity. A MgO content exceeding 20 wt % makes the melting point too high, and therefore, is not preferred.

In the mold powder of the present invention, the content of fluorine which is an unavoidable impurity, is preferably not more than 2 wt %, and more preferably not more than 1 wt %. Most preferably, fluorine is not substantially contained. A fluorine content of more than 2 wt % is not preferred because it allows a greater amount of fluorine to be dissolved in the secondary cooling water, thus drastically accelerating corrosion of the continuous casting equipment.

The mold powder of the present invention may contain not more than 20 wt % of, at least one component selected from the group consisting of $Na_2O$, $Li_2O$, and $K_2O$. A content of these component(s) exceeding 20 wt % is not preferred because the melting characteristics deteriorate.

The mold powder of the present invention may also contain carbon within the range of 0.5 to 30 wt %. A carbon controls the melting rate of the mold powder, and also is required for obtaining and improving the meniscus temperature by its oxidization exothermic reaction. The carbon content of less than 0.5 wt % is not preferred because sufficient effect is not expected, while a carbon content of more than 30 wt % is also not preferred because although the heat retaining property increases, the melting rate becomes too low.

The mold powder of the present invention may also contain not more than 20 wt % of $Al_2O_3$. An $Al_2O_3$ content of more than 20 wt % is not preferred because it makes the melting point too high and the lubricity and heat dissipation characteristics deteriorate.

The mold powder of the present invention may also contain, as additional flux, at least one component selected from the group consisting of MnO, $B_2O_3$ BaO SrO, $TiO_2$, $Fe_2O_3$, etc., within the range of 0.3 to 20 wt %. A content of less than 0.3 wt % is not preferred because sufficient effect is not expected, while a content of more than 20 wt % is also not preferred because the melting properties deteriorate.

The viscosity of the mold powder of the present invention in a molten state at 1,300° C. is not less than 4 poise, desirably 4 to 200 poise, preferably 5 to 200 poise, more preferably 5 to 180 poise, and most preferably, 5 to 170 poise. A viscosity of less than 4 poise is not preferred because crystals of gehlenite, dicalcium silicate and tricalcium silicate may develop to excess in the mold powder, and temperature fluctuation at the copper plate of the mold may increase. When the viscosity exceeds 200 poise, the viscous flow may be impaired, which makes it hard for the mold powder slag to flow into the gaps between the mold and the solidifying shell, and thus, the consumption of the mold powder may be remarkably decreased, making it easier for breakout to occur.

The softening point of the mold powder is preferably 1,070 to 1,250° C., and more preferably 1080 to 1230° C. A softening point lower than 1,070° C. necessarily makes the viscosity too low, and therefore, is not preferred. On the other hand, a softening point higher than 1,250° C. is also not preferred because incomplete melting easily occurs in that case.

The mold powder may have no crystallization temperature, or a crystallization temperature of lower than 1,250° C., preferably lower than 1220° C. When the mold powder does not crystallize, the solidification temperature is lower than 1,300° C., preferably lower than 1260° C. A crystallization temperature higher than 1,250° C. increases the difference in solidification temperatures between the high-melting crystal layer and the low-melting glass layer in the molten mold powder, and therefore, is not preferred. In this case, nonuniform slag film is formed, and the heat dissipation from the solidifying shell is rendered unstable. Further, the thickness of the crystal layer in the slag film increases, and the film is easily ruptured with tensile stress, and thus the risk that sticking between the mold and the solidifying shell occurs increases. When the crystallization temperature is lower than 1,250° C., the difference in solidification temperatures between the high-melting crystal layer and the low-melting glass layer in the slag film is small, and uniform slag film is easily obtained; thus, the heat dissipation is stabilized. Also, the thickness of the crystal layer in the slag film is not too large, so that it is difficult for rupture of the film to occur. Preferably, the mold powder does not crystallize, because in that case the slag film forms a homogeneous amorphous layer, and the heat dissipation is performed uniformly, and the film is hard to be torn due to the ductility of the glass against tensile stress. When the mold powder does not crystallize, a solidification temperature of not less than 1,300° C. is not preferred because incomplete melting may occur, and there is also a problem that slag bear develops to excess, and impedes the flow of the slag into the gaps between the mold and the solidifying shell. The solidification temperature is more preferably in the range of, 1000° C. or more, and less than 1,300° C.

When a platinum cylinder of 5 mm in diameter is suspended from a weight scale in a molten mold powder of 1,300° C., and pulled up at a constant speed, the rupture strength of the molten mold powder is defined as the maximum load when the cylinder comes away from the liquid level and the droplet of the mold powder breaks. The rupture strength of the molten mold powder at 1,300° C. is preferably not lower than 3.0 g/cm$^2$, and more preferably, not lower than 3.7 g/cm$^2$. A rupture strength of lower than 3.0 g/cm$^2$ is not preferred because rupture of the solution layer in the slag film easily occurs.

The method of continuous casting of steel using the mold powder of the present invention will be explained hereafter.

Preferably, the consumption of mold powder for casting slabs, blooms, beam blanks, and billets, is 0.02 to 0.03 kg/m$^2$, and more preferably 0.05 to 0.30 kg/m$^2$, and most preferably 0.07 to 0.25 kg/m$^2$. When consumption of the mold powder exceeds 0.30 kg/m$^2$, the mold powder slag does not flow into the gaps between the mold and the cast slab uniformly, and heat dissipation is rendered unstable. Also, the quality of the cast slag deteriorates, for example, the oscillation marks may be deeply disturbed. A consumption of the mold powder of less than 0.02 kg/m$^2$ is not preferred because the air gap arises significantly and the thickness of the solidifying shell decreases, so that the risk of breakout increases.

ADVANTAGES OF THE INVENTION

The present invention is able to provide a mold powder for continuous casting of steel, which allows stable continuous casting of steel, and which does not substantially contain fluorine, and a method for continuous casting of steel using the mold powder.

EMBODIMENTS

The mold powder for continuous casting of steel and the method for continuous casting of steel according to the present invention will be explained, referring to the examples.

EXAMPLES

In the following tables, Table 1 to Table 4, the chemical compositions and characteristics of the mold powder of the present invention and comparative products are shown.

In addition, the examples in which the mold powder of the present invention and comparative products are used are also shown in Table 1 to Table 4.

TABLE 1

| | Present Invention | | | | | | |
|---|---|---|---|---|---|---|---|
| | 1 | 2 | 3 | 4 | 5 | 6 | 7 |
| Chemical Composition of Mold Powder (wt %) | | | | | | | |
| $SiO_2$ | 54 | 50 | 44 | 45 | 40 | 47 | 43 |
| $Al_2O_3$ | 12 | 10 | 9 | 8 | 12 | 10 | 10 |
| CaO | 12 | 18 | 20 | 27 | 24 | 31 | 34 |
| MgO | 2 | 8 | 5 | 7 | 11 | 10 | 5 |
| $Na_2O + Li_2O + K_2O$ | 11 | 9 | 18 | 10 | 4 | 3 | 6 |
| F | 0 | 0 | 0 | 0 | 0 | 0 | 0 |
| MnO + BaO + SrO + $B_2O_3$ | 6 | 2 | 0 | 0 | 7 | 0 | 0 |
| Amount of total carbon | 3 | 3 | 4 | 3 | 2 | 2 | 2 |
| wt ratio of $CaO/SiO_2$ | 0.22 | 0.36 | 0.45 | 0.60 | 0.60 | 0.66 | 0.79 |

TABLE 1-continued

| | Present Invention | | | | | | |
|---|---|---|---|---|---|---|---|
| | 1 | 2 | 3 | 4 | 5 | 6 | 7 |
| Characteristics | | | | | | | |
| Softening Point (° C.) | 1190 | 1160 | 1100 | 1100 | 1120 | 1150 | 1160 |
| Crystallization temp. (° C.) | — | — | — | — | — | — | 1180 |
| Solidification Temp. (° C.) | 1180 | 1160 | 1120 | 1080 | 1100 | 1140 | — |
| Primary Crystal | Nil | Nil | Nil | Nil | Nil | Nil | (3) |
| Crystal Strength Index | 0 | 0 | 0 | 0 | 0 | 0 | 1 |
| Viscosity (poise at 1300° C.) | 45 | 31 | 15 | 20 | 23 | 39 | 14 |
| Rupture Strength (g/cm$^2$ at 1300° C.) | 6.3 | 6.0 | 5.0 | 5.4 | 5.5 | 6.5 | 4.5 |
| Result of continuous casting | | | | | | | |
| Application | BL | BL | BL | BL | BL | BB | BT |
| Consumption (kg/m$^2$) | 0.07 | 0.12 | 0.20 | 0.14 | 0.18 | 0.15 | 0.07 |
| State at Melt | Good | Good | Good | Good | Good | Good | Good |
| Copper thermal stability | 1 | 2 | 1 | 2 | 1 | 2 | 2 |
| Sticking occurred | 0 | 0 | 0 | 0 | 0 | 0 | 0 |
| Crack occurred | 0 | 0 | 0 | 0 | 0 | 0 | 0 |
| Index of Machine corrosion | 0 | 0 | 0 | 0 | 0 | 0 | 0 |

TABLE 2

| | Present Invention | | | | | | |
|---|---|---|---|---|---|---|---|
| | 8 | 9 | 10 | 11 | 12 | 13 | 14 |
| Chemical Composition of Mold Powder (wt %) | | | | | | | |
| $SiO_2$ | 36 | 38 | 29 | 40 | 41 | 30 | 48 |
| $Al_2O_3$ | 6 | 7 | 12 | 12 | 15 | 16 | 18 |
| CaO | 36 | 41 | 41 | 24 | 22 | 12 | 16 |
| MgO | 4 | 3 | 8 | 1 | 0 | 1 | 1 |
| $Na_2O + Li_2O + K_2O$ | 7 | 7 | 6 | 4 | 3 | 3 | 2 |
| F | 0 | 1 | 1 | 0 | 1 | 0 | 1 |
| MnO + BaO + SrO + $B_2O_3$ | 8 | 0 | 0 | 6 | 1 | 10 | 4 |
| Amount of total carbon | 3 | 3 | 3 | 13 | 17 | 28 | 10 |
| wt ratio of $CaO/SiO_2$ | 1.00 | 1.08 | 1.41 | 0.60 | 0.54 | 0.40 | 0.33 |
| Characteristics | | | | | | | |
| Softening Point (° C.) | 1160 | 1170 | 1200 | 1120 | 1130 | 1100 | 1195 |
| Crystallization temp. (° C.) | 1190 | 1200 | 1180 | — | — | 1050 | — |
| Solidification Temp. (° C.) | — | — | — | 1085 | 1150 | — | 1100 |
| Primary Crystal | (3) | (1) | (1) | Nil | Nil | (4) | Nil |
| Crystal Strength Index | 1 | 1 | 1 | 0 | 0 | 1 | 0 |
| Viscosity (poise at 1300° C.) | 6 | 7 | 5 | 30 | 80 | 100 | 150 |
| Rupture Strength (g/cm$^2$ at 1300° C.) | 4.0 | 3.9 | 4.2 | 5.9 | 7.0 | 8.5 | 9.0 |
| Result of continuous casting | | | | | | | |
| Application | BT | SL | BT | BL | SL | BB | BT |
| Consumption (kg/m$^2$) | 0.11 | 0.16 | 0.15 | 0.18 | 0.10 | 0.20 | 0.05 |
| State at Melt | Good | Good | Good | Good | Good | Good | Good |
| Copper thermal stability | 1 | 2 | 2 | 2 | 1 | 0 | 0 |
| Sticking occurred | 0 | 0 | 0 | 1 | 0 | 0 | 0 |
| Crack occurred | 0 | 0 | 0 | 0 | 0 | 1 | 0 |
| Index of Machine corrosion | 0 | 1 | 2 | 0 | 1 | 0 | 1 |

TABLE 3

| | Present Invention | | | | | | |
|---|---|---|---|---|---|---|---|
| | 15 | 16 | 17 | 18 | 19 | 20 | 21 |
| Chemical Composition of Mold Powder (wt %) | | | | | | | |
| $SiO_2$ | 50 | 52 | 54 | 41 | 35 | 50 | 36 |
| $Al_2O_3$ | 19 | 18 | 14 | 12 | 13 | 12 | 7 |
| CaO | 14 | 13 | 11 | 32 | 27 | 26 | 29 |
| MgO | 0 | 1 | 0 | 3 | 2 | 2 | 1 |
| $Na_2O + Li_2O + K_2O$ | 0 | 1 | 0 | 4 | 0 | 2 | 9 |
| F | 0 | 0 | 0 | 0 | 0 | 0 | 0 |
| $MnO + BaO + SrO + B_2O_3$ | 5 | 5 | 9 | 1 | 13 | 4 | 15 |
| Amount of total carbon | 12 | 10 | 15 | 7 | 10 | 4 | 3 |
| wt ratio of $CaO/SiO_2$ | 0.28 | 0.25 | 0.20 | 0.78 | 0.77 | 0.52 | 0.81 |
| Characteristics | | | | | | | |
| Softening Point (° C.) | 1220 | 1225 | 1240 | 1090 | 1110 | 1090 | 1080 |
| Crystallization temp. (° C.) | — | — | 1145 | 1080 | — | — | 1120 |
| Solidification Temp. (° C.) | 1220 | 1225 | — | — | 920 | 1020 | — |
| Primary Crystal | Nil | Nil | (4) | (4) | — | — | (4) |
| Crystal Strength Index | 0 | 0 | 2 | 1 | 0 | 0 | 2 |
| Viscosity (poise at 1300° C.) | 170 | 180 | 200 | 15 | 25 | 48 | 5 |
| Rupture Strength ($g/cm^2$ at 1300° C.) | 10.4 | 11.0 | 12.1 | 4.5 | 5.2 | 7.2 | 3.2 |
| Result of continuous casting | | | | | | | |
| Application | BB | SL | BL | BB | SL | SL | BT |
| Consumption ($kg/m^2$) | 0.07 | 0.05 | 0.05 | 0.18 | 0.18 | 0.17 | 0.15 |
| State at Melt | Good | Good | Good | Good | Good | Good | Good |
| Copper thermal stability | 0 | 2 | 2 | 1 | 2 | 2 | 2 |
| Sticking occurred | 0 | 0 | 1 | 0 | 1 | 0 | 1 |
| Crack occurred | 1 | 1 | 2 | 0 | 0 | 0 | 0 |
| Index of Machine corrosion | 0 | 0 | 0 | 0 | 0 | 0 | 0 |

TABLE 4

| | Comparative Examples | | | | | |
|---|---|---|---|---|---|---|
| | 1 | 2 | 3 | 4 | 5 | 6 |
| Chemical Composition of Mold Powder (wt %) | | | | | | |
| $SiO_2$ | 38 | 26 | 29 | 29 | 42 | 29 |
| $Al_2O_3$ | 7 | 10 | 10 | 5 | 11 | 12 |
| CaO | 35 | 32 | 53 | 32 | 7 | 43 |
| MgO | 4 | 7 | 2 | 9 | 8 | 3 |
| $Na_2O + Li_2O + K_2O$ | 10 | 20 | 4 | 20 | 27 | 10 |
| F | 3 | 0 | 0 | 0 | 0 | 0 |
| $MnO + BaO + SrO + B_2O_3$ | 0 | 0 | 0 | 0 | 0 | 0 |
| Amount of total carbon | 3 | 5 | 2 | 5 | 5 | 3 |
| wt ratio of $CaO/SiO_2$ | 0.92 | 1.23 | 1.82 | 1.10 | 0.17 | 1.48 |
| Characteristics | | | | | | |
| Softening Point (° C.) | 1060 | 1120 | 1360 | 1060 | 1180 | 1200 |
| Crystallization temp. (° C.) | 1050 | 1290 | 1420 | 1240 | — | 1350 |
| Solidification Temp. (° C.) | — | — | — | — | 1280 | — |
| Primary Crystal | (2) | (1) | (1) | (1) | Nil | (1) |
| Crystal Strength Index | 3 | 8 | 10 | 5 | 0 | 10 |

TABLE 4-continued

| | Comparative Examples | | | | | |
|---|---|---|---|---|---|---|
| | 1 | 2 | 3 | 4 | 5 | 6 |
| Viscosity (poise at 1300° C.) | 8 | 3 | — | 3 | 40 | — |
| Rupture Strength ($g/cm^2$ at 1300° C.) | 3.8 | 3.4 | — | 4.0 | 4.2 | — |
| Result of continuous casting | | | | | | |
| Application | BL | BL | — | BL | BL | BL |
| Consumption ($kg/m^2$) | 0.25 | 0.20 | — | 0.28 | 0.11 | 0.06 |
| State at Melt | Good | Bad | — | Good | Bad | Bad |
| Copper thermal stability | 1 | 6 | — | 7 | 1 | 8 |
| Sticking occurred | 0 | 3 | — | 1 | 3 | 4 |
| Crack occurred | 0 | 4 | — | 5 | 1 | 4 |
| Index of Machine corrosion | 5 | 1 | — | 1 | 1 | 1 |

In the section of the application shown in Table 1 to Table 4, SL, BL, BB, and BT denote the continuous casting of slabs, blooms, beam blanks, and billets, respectively.

In the section of the primary crystal, (1), (2), (3) and (4) denote dicalcium silicate ($2CaO.SiO_2$), cuspidine ($3CaO.2SiO_2.CaF_2$), wollastonite($CaO.SiO_2$), and gehlenite ($2CaO.Al_2O_3.SiO_2$), respectively.

In addition, strength of primary crystals, copper plate stability index, sticking occurrence index, cast slab fracture index, and continuous casting equipment corrosion index shown in the tables, are evaluated at a scale of 0 to 10, wherein the larger number shows the worse extent.

What is claimed is:

1. A mold powder for continuous steel casting comprising 25 to 70 wt % of $SiO_2$, 10 to 50 wt % of CaO, not more than 20 wt % of MgO, 0.5 to 30 wt % of carbon, and substantially 0 wt % of F as unavoidable impurity, and having a viscosity of not less than 4 poise in a molten state at 1,300° C.

2. A mold powder for continuous casting of steel according to claim 1, wherein the mold powder in a molten state at 1,300° C. has a viscosity ranging from 4 to 200.

3. A mold powder for continuous casting of steel according to claim 1, wherein the total content of at least one component which is selected from the group consisting of $Na_2O$, $Li_2O$, and $K_2O$ is not more than 20 wt %.

4. A mold powder for continuous casting of steel according to claim 1, wherein the ratio by weight of $CaO/SiO_2$ is in the range of 0.2 to 1.5.

5. A mold powder for continuous steel casting according to claim 1, wherein a softening point is in the range of 1,070 to 1,250° C.

6. A mold powder for continuous casting of steel according to claim 1, wherein the mold powder in the molten state at 1,300° C. has a rupture strength of not less than 3.0 $g/cm^2$.

7. A mold powder for continuous steel casting according to claim 1, wherein a content of $Al_2O_3$ is not more than 20 wt %.

8. A mold powder for continuous steel casting according to claim 1, wherein a total content of at least one component selected from the group consisting of MnO, $B_2O_3$, SrO, BaO and $Fe_2O_3$ is in the range of 0.3 to 20 wt %.

9. A mold powder for continuous casting of steel according to claim 1, wherein the mold powder has either no crystallization temperature or a crystallization temperature of less than 1,250° C.

10. A mold powder for continuous casting of steel according to claim 1, wherein the mold powder has no crystillization temperature, and the solidification temperature is less than 1,300° C.

11. A method comprising continuous casting of steel in the presence of the mold powder according to claim 1, wherein the powder consumption is in the range of 0.02 to 0.30 $kg/m^2$.

12. A method of making a mold powder, the method comprising mixing $SiO_2$, CaO, MgO and C; and producing the mold powder of claim 1.

* * * * *